US009797574B2

(12) United States Patent
Yang et al.

(10) Patent No.: US 9,797,574 B2
(45) Date of Patent: Oct. 24, 2017

(54) LIGHT-EMITTING DIODE OBSTRUCTION LIGHT

(71) Applicants: Yi Yang, North Syracuse, NY (US); Patrick Stephen Blincoe, Kirkville, NY (US); Kantesh Vittal Agnihotri, Mysore (IN)

(72) Inventors: Yi Yang, North Syracuse, NY (US); Patrick Stephen Blincoe, Kirkville, NY (US); Kantesh Vittal Agnihotri, Mysore (IN)

(73) Assignee: Cooper Technology Company, Houston, TX (US)

( * ) Notice: Subject to any disclaimer, the term of this patent is extended or adjusted under 35 U.S.C. 154(b) by 127 days.

(21) Appl. No.: 14/609,143

(22) Filed: Jan. 29, 2015

(65) Prior Publication Data

US 2015/0219309 A1 Aug. 6, 2015

Related U.S. Application Data

(60) Provisional application No. 61/935,199, filed on Feb. 3, 2014.

(51) Int. Cl.

| | |
|---|---|
| ***F21V 7/06*** | (2006.01) |
| ***F21S 8/00*** | (2006.01) |
| *F21V 13/04* | (2006.01) |
| *F21W 111/00* | (2006.01) |
| *F21W 131/10* | (2006.01) |
| *F21V 3/04* | (2006.01) |
| *F21Y 101/00* | (2016.01) |
| *F21Y 115/10* | (2016.01) |
| *F21Y 107/00* | (2016.01) |

(52) U.S. Cl.

CPC ..... *F21V 7/06* (2013.01); *F21S 8/003* (2013.01); *F21V 3/0472* (2013.01); *F21V 13/04* (2013.01); *F21W 2111/00* (2013.01); *F21W 2131/10* (2013.01); *F21Y 2101/00* (2013.01); *F21Y 2107/00* (2016.08); *F21Y 2115/10* (2016.08)

(58) Field of Classification Search

CPC ..... F21V 7/06; F21V 7/0025; F21V 7/0033; F21S 8/003

See application file for complete search history.

(56) References Cited

U.S. PATENT DOCUMENTS

| | | | | |
|---|---|---|---|---|
| 3,443,086 | A * | 5/1969 | Vitolds | F21V 7/0016 359/858 |
| 5,335,157 | A | 8/1994 | Lyons | |
| 5,929,788 | A * | 7/1999 | Vukosic | B60Q 1/2611 340/471 |
| 6,679,618 | B1 | 1/2004 | Suckow et al. | |
| 6,844,824 | B2 | 1/2005 | Vukosic | |
| 7,079,041 | B2 | 7/2006 | Fredericks et al. | |
| 7,378,983 | B2 | 5/2008 | Wang et al. | |
| 7,497,593 | B2 | 3/2009 | Wang | |
| 7,604,384 | B2 | 10/2009 | Peck | |
| 7,731,384 | B2 | 6/2010 | Curran et al. | |

(Continued)

*Primary Examiner* — Thomas M Sember

(74) *Attorney, Agent, or Firm* — King & Spalding LLP

(57) ABSTRACT

An obstruction light is disclosed herein. The obstruction light can include a reflector having a first parabolic portion and a second parabolic portion. The obstruction light can also include a light assembly having at least one array of light sources disposed adjacent to the reflector between the first parabolic portion and the second parabolic portion.

18 Claims, 5 Drawing Sheets

(56) References Cited

U.S. PATENT DOCUMENTS

| | | | | |
|---|---|---|---|---|
| 7,832,908 | B2 | 11/2010 | Peck et al. | |
| 8,066,400 | B2 | 11/2011 | Curran et al. | |
| 8,851,707 | B2 | 10/2014 | Peck | |
| 2003/0043585 | A1* | 3/2003 | Rohlfing | F21V 7/0058 362/302 |
| 2011/0235322 | A1 | 9/2011 | Fields et al. | |
| 2012/0134153 | A1* | 5/2012 | Suzuki | F21V 7/0008 362/238 |

* cited by examiner

LIGHT-EMITTING DIODE OBSTRUCTION LIGHT

CROSS-REFERENCE TO RELATED APPLICATIONS

This application claims priority under 35 U.S.C. §119 to U.S. Provisional Patent Application Ser. No. 61/935,199, titled "Light-Emitting Diode Obstruction Light" and filed on Feb. 3, 2014, the entire contents of which are hereby incorporated herein by reference.

TECHNICAL FIELD

Embodiments described herein relate generally to light fixtures, and more particularly to systems, methods, and devices for light-emitting diode (LED) obstruction light fixtures.

BACKGROUND

An obstruction light (also sometimes called a beacon light) can be used to alert someone within sight of the light emitted by the obstruction light of a hazard. For example, an aircraft obstruction light, can be used to alert a pilot as to an obstacle that may provide a hazard to aircraft navigation. Obstruction lights are typically used on buildings, towers, and other tall structures.

SUMMARY

In general, in one aspect, the disclosure relates to an obstruction light. The obstruction light can include a reflector having a first parabolic portion and a second parabolic portion. The obstruction light can also include a light assembly having at least one array of light sources disposed adjacent to the reflector between the first parabolic portion and the second parabolic portion.

In another aspect, the disclosure can generally relate to a reflector for an obstruction light. The reflector can include a first parabolic portion and a second parabolic portion. The first parabolic portion and the second parabolic portion can each be adjacent to a light assembly having at least one array of light sources.

These and other aspects, objects, features, and embodiments will be apparent from the following description and the appended claims.

BRIEF DESCRIPTION OF THE DRAWINGS

The drawings illustrate only example embodiments of light-emitting diode (LED) obstruction lights and are therefore not to be considered limiting of its scope, as LED obstruction lights may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
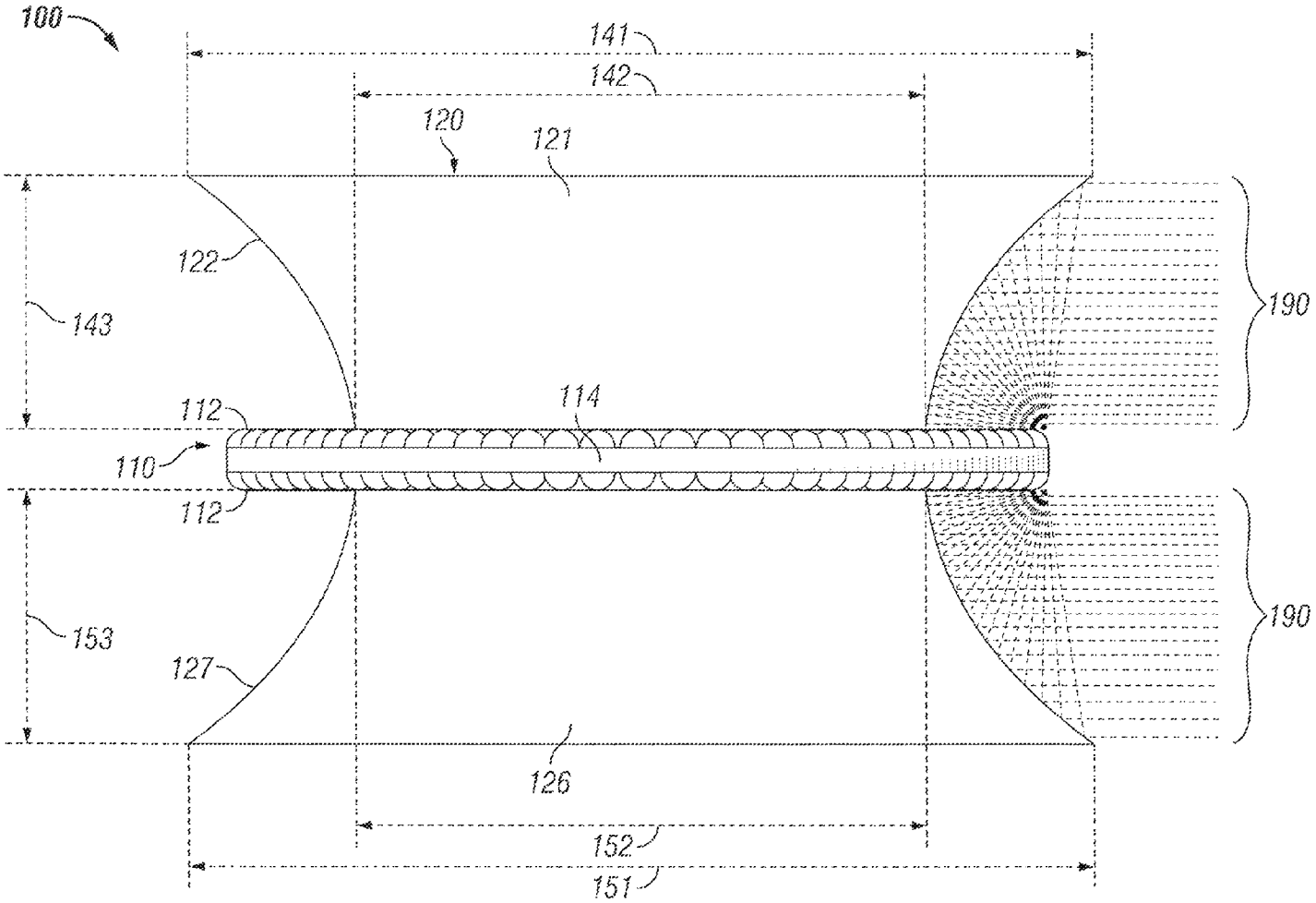
FIG. 1 shows a side view of an example obstruction light assembly in accordance with certain example embodiments.

The example embodiments discussed herein are directed to systems, methods, and devices for an LED obstruction light. Certain example embodiments provide a number of benefits. Examples of such benefits include, but are not limited to, a high light efficiency, a narrow beam spread, reduced cost, compact design, and high thermal efficiency.

While the example embodiments described herein are directed to LED obstruction lights, example embodiments can also be used for any type of light (e.g., egress lighting) and/or any type of lighting technology (e.g., halogen, mercury vapor, fluorescent, incandescent). Therefore, example embodiments described herein should not be considered limited to any particular type of fixture and/or lighting system. As used herein, the term "parabolic" means a shape that is concave. A parabolic shape can be in the shape of a portion of an actual parabola. Alternatively, a parabolic shape can have a shape that is otherwise concave but not parabolic.

The obstruction lights (or components thereof, such as individual light modules) described herein can be made of one or more of a number of suitable materials to allow the obstruction light to meet certain standards and/or regulations while also maintaining durability in light of the one or more conditions under which the example light fixture can be exposed. Examples of such materials can include, but are not limited to, aluminum, stainless steel, fiberglass, glass, plastic, and rubber. Obstruction lights described herein can be rated for one or more of a number (or range) of light colors (CCT), color rendering index (CRI), voltages, and/or amperes. Example obstruction lights described herein should not be considered limited to a particular CCT, CRI, voltage, and/or amperage rating.

In one or more example embodiments, obstruction lights are subject to meeting certain standards and/or requirements. For example, the International Electrotechnical Commission (IEC) publishes ratings and requirements for obstruction lights. Specifically, the IEC publishes IP (which stands for Ingress Protection or, alternatively, International Protection) Codes that classify and rate the degree of protection provided against intrusion of solid objects, dust, and water in mechanical casings and electrical enclosures. One such IP Code is IP66, which means that an obstruction light having such a rating is dust tight and protects against powerful water jets (in this case, 100 liters of water per minute under a pressure of 100 $kN/m^2$ at a distance of 3 meters) for a duration of at least 3 minutes. Examples of other entities that can establish and maintain relevant standards and/or regulations can include, but are not limited to, the Federal Aviation Administration (FAA) and the International Civil Aviation Organization (ICAO).

Any components (e.g., reflector, plate, lens, housing) of example obstruction lights, or portions thereof, described herein can be made from a single piece (as from a mold, injection mold, die cast, or extrusion process). In addition, or in the alternative, a component (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with an obstruction light. Examples of a user may include, but are not limited to, an engineer, an electrician, a maintenance technician, a mechanic, an operator, a consultant, a contractor, and a manufacturer's representative. Further, as used herein, the term "diameter" is used to describe a dimension of a component of an obstruction light. A diameter can be used to describe a dimension for a circular component, an oval-shaped component, a square-shaped component, a rectangular component, a hexagonally-shaped component, or any other shape for a component. For example, a diameter can be used to describe a dimension from one side of a reflector portion to another side of the reflector portion, regardless of the shape of the reflector portion.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

Example embodiments of obstruction lights will be described more fully hereinafter with reference to the accompanying drawings, in which example embodiments of obstruction lights are shown. Obstruction lights may, however, be embodied in many different forms and should not be construed as limited to the example embodiments set forth herein. Rather, these example embodiments are provided so that this disclosure will be thorough and complete, and will fully convey the scope of obstruction lights to those of ordinary skill in the art. Like, but not necessarily the same, elements (also sometimes called components) in the various figures are denoted by like reference numerals for consistency.

Terms such as "first," "second," "top," "center," "width," "height," "bottom," "inner," "outer," and "side" are used merely to distinguish one component (or part of a component or state of a component) from another. Such terms are not meant to denote a preference or a particular orientation, and are not meant to limit embodiments of light fixtures using assembly systems. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a side view of an obstruction light assembly 100 in accordance with certain example embodiments. The obstruction light assembly 100 can include a light assembly 110 and a reflector 120. The reflector 120 can include one or more portions, where each portion has a parabolic shape. For example, as shown in FIG. 1, the reflector 120 can have a top parabolic portion 121 and a bottom parabolic portion 126. Each portion (e.g., the top parabolic portion 121, the bottom parabolic portion 126) of the reflector 120 can be a single piece, where the light assembly 110 is disposed adjacent to the two portions. Alternatively, as shown in FIGS. 2 and 3 below, each portion of the reflector 120 can be separate pieces that are coupled to a portion (e.g., the plate) of the light assembly 110.

The top parabolic portion 121 can have a curvature 122, and the bottom parabolic portion 126 can have a curvature 127. The curvature 122 can be substantially the same as, or different than, the curvature 127. For example, the curvature 122 of FIG. 1 is substantially the same as the curvature 127. In certain example embodiments, the light assembly 110 is disposed between and/or adjacent to the top parabolic portion 121 and the bottom parabolic portion 126.

Similarly, other features (e.g., the inner diameter 142, the outer diameter 141, the height 143) of the top parabolic portion 121 can be substantially the same as, and/or different than, the corresponding features (e.g., the inner diameter 152, the outer diameter 151, the height 153) of the bottom parabolic portion 126. For example, as shown in FIG. 1, the various features of the top parabolic portion 121 can be substantially the same as the corresponding features of the bottom parabolic portion 126. In such a case, the top parabolic portion 121 can be substantially identical to, and a mirror image of, the bottom parabolic portion 126.

Each portion of the reflector 120 can be formed from a single piece, or the portions of the reflector 120 can be separate pieces that are mechanically coupled to each other. Each portion of the reflector 120 can be made of one or more of a number of reflective materials. In addition, or in the alternative, each portion of the reflector 120 can have a specular reflective surface with a high reflectance and/or can have one or more features (e.g., facets, segments, texture) on its reflective surface.

In certain example embodiments, the light assembly 110 can include at least one array of light sources 112 and a light board 114. Each array of light sources 112 can be mechanically (and, in some cases, electrically coupled) to the light board 114. For example, as shown in FIG. 1, there is one array of light sources 112 disposed on the top side of the light board 114, and there is another array of light sources 112 disposed on the bottom side of the light board 114. In such a case, the top array of light sources 112 is directed toward the top parabolic portion 121, and the bottom array of light sources 112 is directed toward the bottom parabolic portion 126. The light board 114 can include wiring that provides power and/or control to each light source of the array of light sources 112.

A light board 114 can be rigid or flexible (e.g., bendable). For example, the light board 114 of FIG. 1 is rigid. The array of light sources 112 disposed on the light board 114 can be continuous or discrete. The light sources of the array of light sources 112 disposed on the light board 114 can be evenly spaced or spaced in an uneven pattern. In certain example embodiments, the light sources of the array of light sources 112 can be positioned substantially at the focal point (the focus based on the curvature) of the portion of the reflector 120 to which the light sources are directed. In addition, or in the alternative, the array of light sources 112 can be disposed adjacent to the reflector 120 between the top parabolic portion 121 and the bottom parabolic portion 126.

The light sources 112 can use one or more of a number of lighting technologies. For example, the light sources 112 can be LEDs. In such a case, the light sources 112 can be undomed to increase the lumen-to-candella conversion efficiency. The light sources 112 can be white, colored, or any combination thereof. In some cases, because the light assembly 110 has a relatively low profile and thus may not have substantial heat sinking capability, the light sources 112 may operate intermittently (e.g., running in a strobe or flash-only mode of operation) rather than be constantly on for significant periods of time.

As discussed below, the orientation of the light sources 112 (e.g., relative to the base or enclosure of the light source, both of which are discussed below) can be vertical, horizontal, and/or any orientation in between. For example, as shown in FIG. 1, the light sources 112 are oriented horizontally with respect to the top parabolic portion 121 and the bottom parabolic portion 126. Other orientations of the light sources 112 are shown in FIGS. 2-5 below.

A number of factors, such as the curvature 122 of the top parabolic portion 121, the curvature 127 of the bottom parabolic portion 126, the distance of the array of light sources 112 from the reflector 120, and the position of the array of light sources 112 relative to the top parabolic portion 121 and the bottom parabolic portion 126, can affect the distribution 190 of light emitted by the array of light sources 112. In certain example embodiments, the distribution 190 of light is specifically designed to meet one or more standards and/or regulations.

Figure 2A:
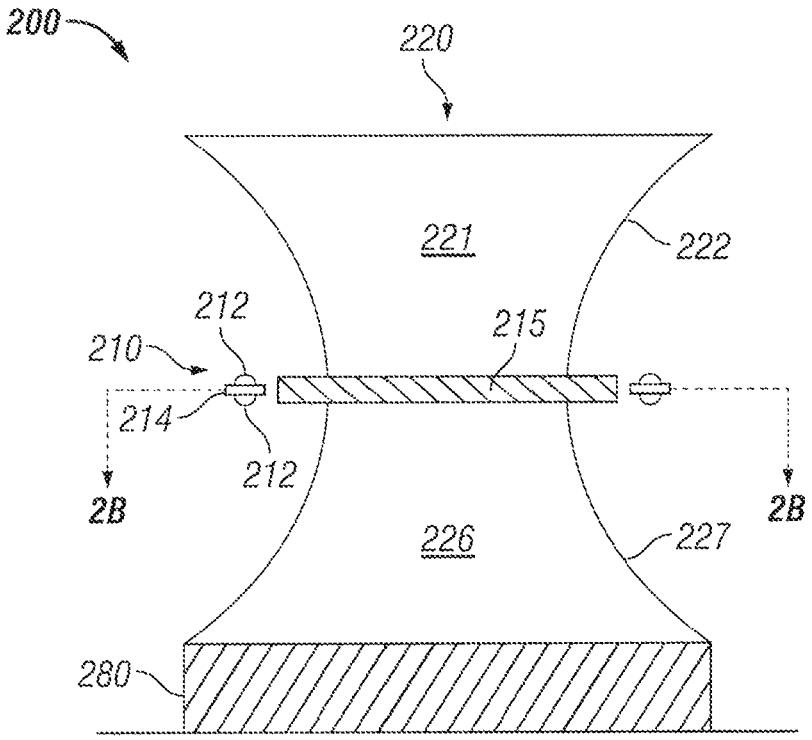
FIGS. 2A and 2B show various views of another example obstruction light assembly in accordance with certain example embodiments.
Figure 2B:
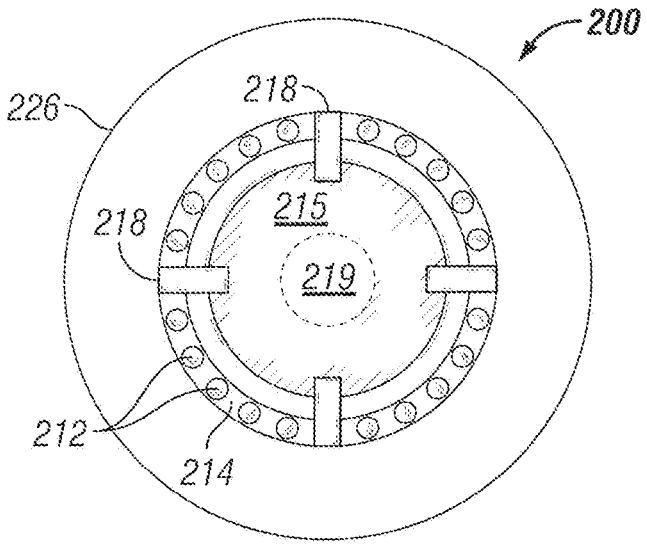
Figure 3A:
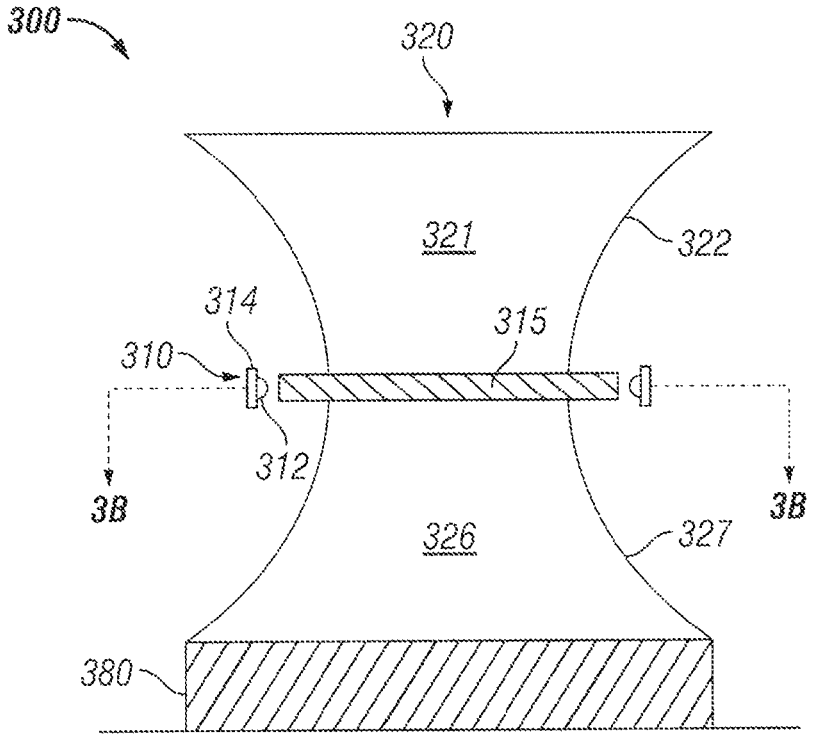
FIGS. 3A and 3B show various views of yet another example obstruction light assembly in accordance with certain example embodiments.
Figure 3B:
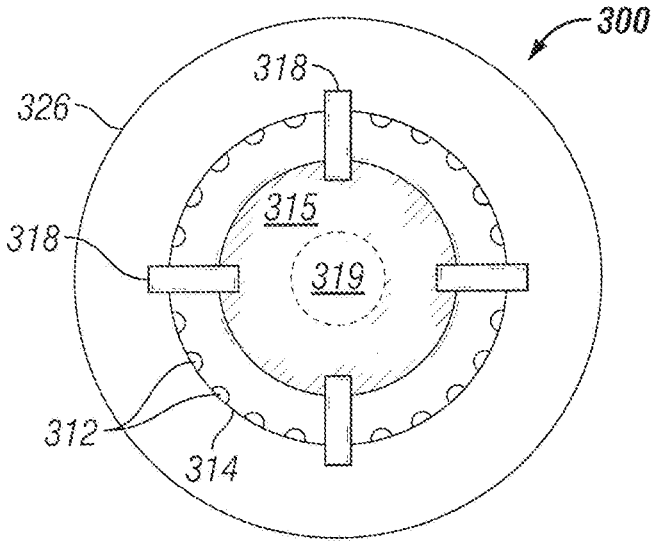
Figure 4:
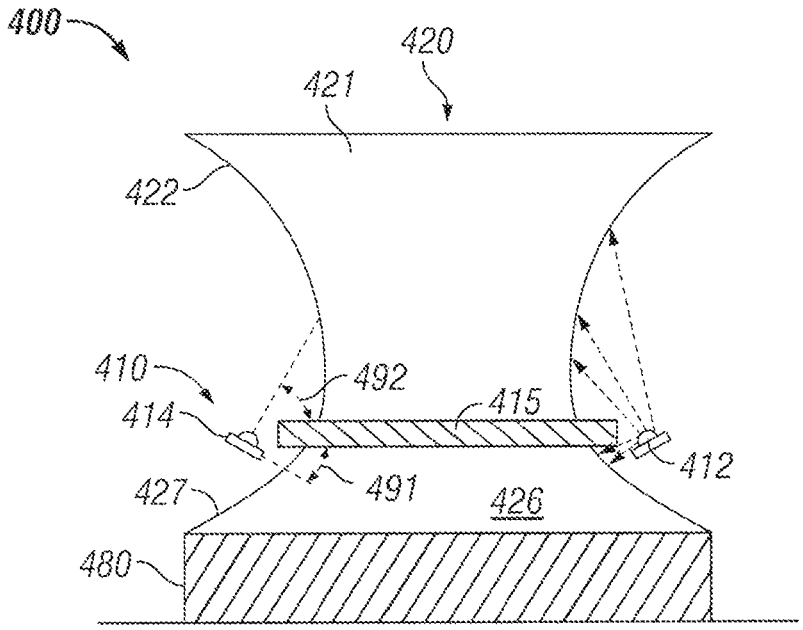
FIG. 4 shows a side view of still another example obstruction light assembly in accordance with certain example embodiments.

FIGS. 2A-4 show a number of example obstruction light assemblies. Specifically, FIGS. 2A and 2B show various views of another example obstruction light assembly 200 in accordance with certain example embodiments. FIGS. 3A and 3B show various views of yet another example obstruction light assembly 300 in accordance with certain example embodiments. FIG. 4 shows a side view of still another example obstruction light assembly 400 in accordance with certain example embodiments. In one or more example embodiments, one or more of the components shown in FIGS. 2A-4 may be omitted, repeated, and/or substituted. Accordingly, example embodiments of obstruction light assemblies (or portions thereof) should not be considered limited to the specific arrangement of components shown in FIGS. 2A-4. Further, labels not shown in FIGS. 2A-4 but referred to with respect to FIGS. 2A-4 can be incorporated by reference from FIG. 1. Similarly, a description of a label shown in FIGS. 2A-4 but not described with respect to FIGS. 2A-4 can use the description from FIG. 1.

The obstruction light assembly 200 of FIGS. 2A and 2B, the obstruction light assembly 300 of FIGS. 3A and 3B, and the obstruction light assembly 400 of FIG. 4 are substantially the same as the obstruction light assembly 100 of FIG. 1, except as described below. Referring to FIGS. 1-4, FIG. 2A shows a cross-sectional side view of the obstruction light assembly 200, and FIG. 2B shows a cross-sectional top view of the obstruction light assembly 200. As with the obstruction light assembly 100 of FIG. 1, the light assembly 210 has two arrays of light sources 212. One array of light sources 212 is disposed on the top side of the light board 214, and the other array of light sources 212 is disposed on the bottom side of the light board 214. The array of light sources 212 are shown in FIG. 2A being disposed adjacent to the reflector 220 between the top parabolic portion 221 and the bottom parabolic portion 226.

In certain example embodiments, the light assembly 210 includes a plate 215. The plate 215 can be disposed between the top parabolic portion 221 and the bottom parabolic portion 226 of the reflector 220. When there is a plate 215, the plate 215 can have an outer perimeter. One or more of the light boards 214 and/or one or more array of light sources 212 can be mechanically and/or electrically coupled to some portion (e.g., the outer perimeter) of the plate 215. In such a case, a light board 214 and/or an array of light sources 212 can be coupled to the plate 215 directly or indirectly. Direct coupling can involve one or more coupling features disposed on the plate 215, the light board 214, and/or the array of light sources 212. Such coupling features can include, but are not limited to, slots, tabs, detents, and apertures.

Alternatively, indirect coupling can involve one or more of a number of independent components that are used in conjunction with the coupling features of the plate 215, the light board 214, and/or the array of light sources 212. Such independent components can include, but are not limited to, a clamp 218 (as shown in FIG. 2B), a fastening device (e.g., a bolt, a screw, a nut), and solder. For example, as shown in FIG. 2B, there are four clamps 218, spaced substantially equidistantly around the outer perimeter of the plate 215, where one end of the clamp 218 is mechanically coupled to the plate 215, and the other end of the clamp 218 is mechanically coupled to the light board 214. In certain example embodiments, an electrical coupling can be made from the plate 215 to the light board 214 using one or more of the clamps 218.

The plate 215 can have a shape that is substantially the same as the cross-sectional shape of the inner portion of the one or more portions of the reflector 220 to which the plate 215 is adjacent. For example, the plate 215 of FIGS. 2A and 2B is substantially circular. Other shapes can include, but are not limited to, triangular, square, rectangular, octagonal, and oval. The size (outer perimeter) of the plate 215 can be larger than, smaller than, or substantially the same as the size of the inner portion of the one or more portions of the reflector 220 to which the plate 215 is adjacent. The plate 215 can be continuous throughout. Alternatively, as shown in FIG. 2B, the plate 215 can have one or more apertures 219 that traverse some or all of the plate 215. Such an aperture 219 can traverse through the center of the plate 215 and/or through any other portion of the plate 215, in a latitudinal and/or in a longitudinal direction.

The plate 215 can include one or more features that allow one or more portion of the reflector 220 to mechanically couple to the plate 215. In addition to an aperture 219, such features can include, but are not limited to, a slot, a tab, a clamp, and a detent. By using such features of the plate 215, the portions of the reflector 220 can be properly aligned so that the light emitted by the array of light sources 212 is distributed in the proper beam pattern by the reflector 220. In addition, or in the alternative, the inner ends of one or more portions of the reflector 220 can have coupling features that allow such portions of the reflector 220 to mechanically couple to the plate 215 according to certain tolerances.

The obstruction light assembly 200 of FIGS. 2A and 2B also includes a base 280. In addition to providing stability and mounting support for the obstruction light assembly 200, the base can be used to house one or more components of the obstruction light assembly 200. Such components can include, but are not limited to, the power source (sometimes called a driver for LED light sources and a ballast for certain other light sources) and a control device. The base 280 can be of any suitable shape and size.

The obstruction light assembly 300 of FIGS. 3A and 3B has a different configuration of the light assembly 310 compared to the configuration of the light assembly 210 of the obstruction light assembly 200 of FIGS. 2A and 2B. Specifically, the array of light sources 312 are disposed on a flexible light board 314 and face inward rather than up or down. In such a configuration, the orientation of each light source 312 of the array of light sources 312 can vary. For example, one light source 312 can be directed toward the top parabolic portion 321 of the reflector 320, and an adjacent light source 312 can be directed toward the bottom parabolic portion 326. Unlike the light assembly 210 of FIGS. 2A and 2B, only one side (the inner side) of the light board 314 has the array of light sources 312 disposed thereon. In addition, the plate 315 of the obstruction light assembly 300 can have an aperture 319 traversing some or all of the plate 315. Such an aperture 319 can traverse through the center of the plate 315 and/or through any other portion of the plate 315, in a latitudinal and/or in a longitudinal direction.

The obstruction light assembly 400 of FIG. 4 has a reflector 420 where the top parabolic portion 421 has a different shape and size compared to the shape and size of the bottom parabolic portion 426. For example, the top parabolic portion 421 has a curvature 422 that is more gradual than the curvature 427 of the bottom parabolic portion 426. As another example, the height 443 of the top parabolic portion 421 can be greater than the height 453 of the bottom parabolic portion 426.

The light assembly 410 is still positioned between the top parabolic portion 421 and the bottom parabolic portion 426. However, because the height 443 of the top parabolic portion 421 can be greater than the height 453 of the bottom parabolic portion 426, the light assembly 410 is not positioned halfway along the height of the reflector 420. In certain example embodiments, the light board 414 on which the array of light sources 412 are disposed can be positioned at an angle that is not parallel or perpendicular to the plate 415. For example, as shown in FIG. 4, the light board 414 can be positioned at an angle 491 relative to the plate 415, where the angle 491 is not 0° or 90°. In such a case, the array of light sources 412 is directed at angle 492 relative to the plate 415. As a result, the light emitted by the array of light sources 412 can be manipulated by the reflector 420 in such a way as to emit a light beam according to a particular design, function, and/or standard.

Figure 5:
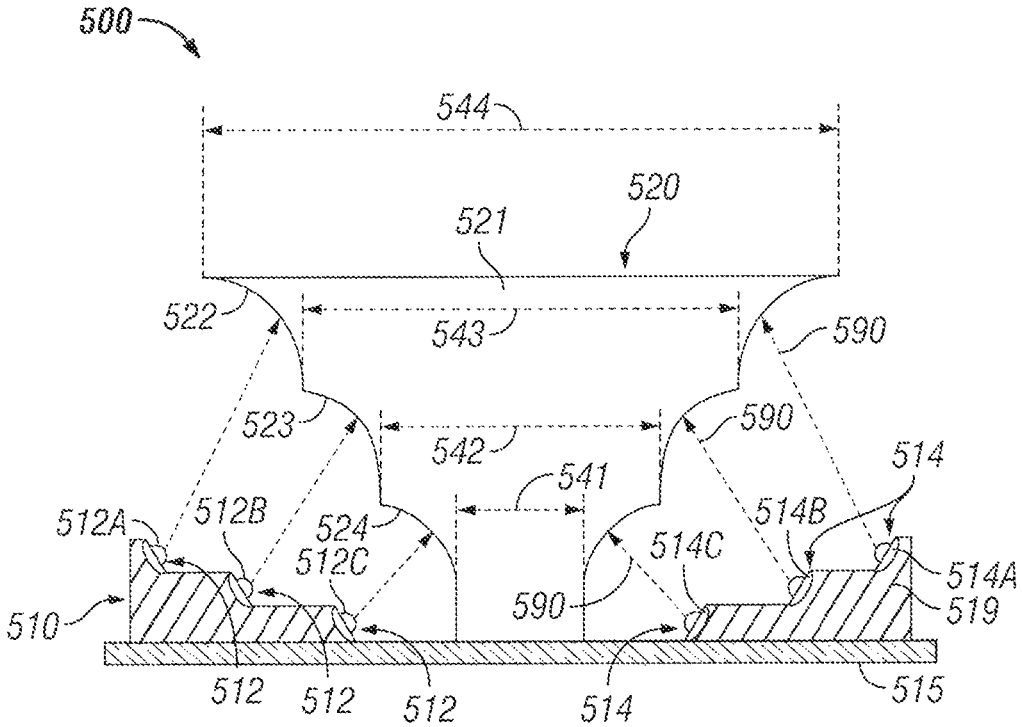
FIG. 5 shows a side view of yet another example obstruction light assembly in accordance with certain example embodiments.

In certain example embodiments, a parabolic portion can have multiple sections. For example, FIG. 5 shows a top half of the obstruction light assembly 500 in accordance with certain example embodiments. Specifically, FIG. 5 shows the top parabolic portion 521 having three different parabolic sections (parabolic section 522, parabolic section 523, and parabolic section 524). A parabolic section can have the same and/or a different curvature compared to the other parabolic sections of a parabolic portion.

When a parabolic portion has multiple parabolic sections, those parabolic sections can be oriented in one or more of a number of ways with respect to each other. For example, as shown in FIG. 5, the parabolic sections can be stacked vertically with respect to each other. In addition, or in the alternative, each parabolic section can have varying shapes and/or sizes. For example, as shown in FIG. 5, while parabolic section 524, parabolic section 523, and parabolic section 522 can have substantially the same curvature, the diameters of each parabolic section vary. Specifically, parabolic section 524 has an inner diameter 541 and an outer diameter 542. The inner diameter 542 of parabolic section 523 is the same as the outer diameter 542 of parabolic section 524. Parabolic section 523 has an outer diameter 543 that is the same as the inner diameter of parabolic section 522. Parabolic section 522 also has outer diameter 544.

The light assembly 510 can have a different configuration than the configurations for the light assemblies shown in FIGS. 1-4. Specifically, the light assembly 510 in FIG. 5 has three arrays of light sources 512 (array of light sources 512A, array of light sources 512B, and array of light sources 512C). Each array of light sources 512 is mounted on a light board 514. Specifically, array of light sources 512A is mounted on light board 514A, array of light sources 512B is mounted on light board 514B, and array of light sources 512C is mounted on light board 514C, Each light board 514 can be mounted on a different portion of a platform 519. For example, light board 514A is mounted toward the outer end of the platform 519, light board 514B is mounted toward the middle of the platform 519, and light board 514C is mounted toward the inner end of the platform 519. The platform 519 can have any of a number of shapes, sizes, and/or features. For example, as shown in FIG. 5, the platform 519 can have a stepped feature, increasing in height from the inner end to the outer end of the platform 519. The surface of the platform 519 on which a light board 514 is mounted can be angled in a certain way to obtain a particular distribution 590 of light. The platform 519 which is mounted on one or more portions (e.g., a top surface, a bottom surface) of the plate 515. In this case, the plate 515 extends beyond the outer diameter 544 of parabolic section 522 and can be disposed between the top parabolic portion 521 and the bottom parabolic portion (not shown).

The number of arrays of light sources can be the same as, or different (more, less) than the number of parabolic sections of a parabolic portion. For example, as shown in FIG. 5, there can be three arrays of light sources 512 (array of light sources 512A, array of light sources 512B, and array of light sources 512C) and three parabolic sections (parabolic section 522, parabolic section 523, and parabolic section 524). The light emitted by each array of light sources 512 can be directed to one or more of the parabolic sections. In this case, the light from array of light sources 512A is directed at parabolic section 522, the light from array of light sources 512B is directed at parabolic section 523, and the light from array of light sources 512C is directed at parabolic section 524. One or more other reflectors (not shown) (e.g., a reflector cup around one or more light sources 512) can be used to help achieve a particular light distribution 590.

The distribution 590 of light emitted by the various arrays of light sources 512 can result in a single beam of light, multiple beams of light, a scattering of light, and/or some other light distribution. One or more of a number of factors can affect the distribution 590 of light of the obstruction light assembly 500, including but not limited to the number of parabolic sections, the curvature of each parabolic section, the height of various portions of the platform 519, the distance of the platform 519 from the parabolic portion 521, the number and/or positioning of the arrays of light sources 512, and the distance of an array of light sources 512 from a parabolic section.

Figure 6:
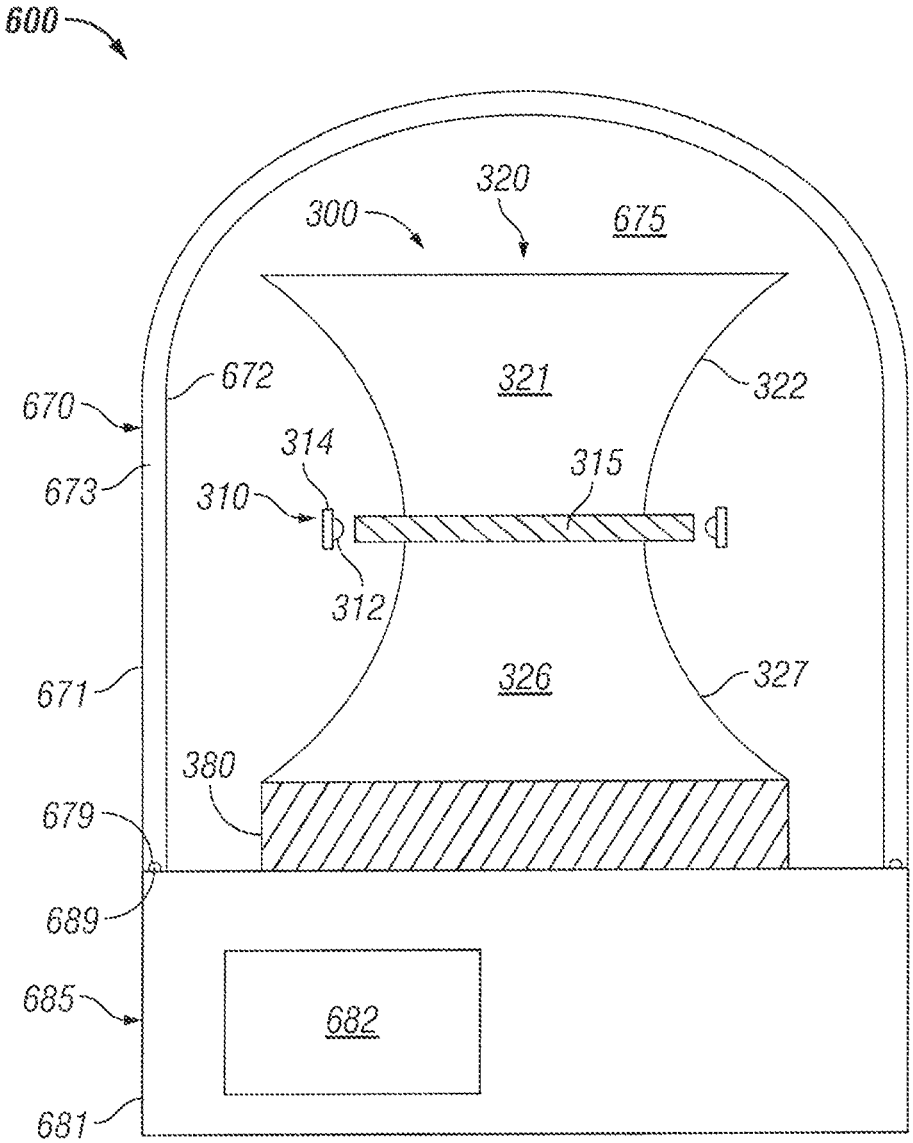
FIG. 6 shows a cross-sectional side view of an example obstruction light, including the obstruction light assembly of FIGS. 3A and 3B, in accordance with certain example embodiments.

FIG. 6 shows a cross-sectional side view of an example obstruction light 600, including the obstruction light assembly 300 of FIGS. 3A and 3B, in accordance with certain example embodiments. In one or more example embodiments, one or more of the components shown in FIG. 6 may be omitted, repeated, and/or substituted. Accordingly, example embodiments of obstruction lights (or portions thereof) should not be considered limited to the specific arrangement of components shown in FIG. 6. For example, any of a number of other obstruction light assemblies (e.g., obstruction light assembly 100, obstruction light assembly 200, obstruction light assembly 400, obstruction light assembly 500) can be substituted for obstruction light assembly 300 shown in FIG. 6.

Referring to FIGS. 1-6, the obstruction light 600 includes the obstruction light assembly 300 (as described above with respect to FIGS. 3A and 3B), a lens 670, a housing 685, and an optional sealing member 689. The lens 670 (also called, among other names, an optical device) can include a wall 673 having a thickness defined by an inner surface 672 and an outer surface 671. The wall 673 of the lens 670 can form a cavity 675 into which the obstruction light assembly 300 can be disposed. In other words, the lens 670 can encompass the obstruction light assembly 300. The lens 670 can be open at its bottom end, allowing the lens 670 to encompass the obstruction light assembly 300.

In certain example embodiments, the bottom end of the lens can have a channel 679 disposed along some or all of its perimeter. In such a case, a sealing member 689 (e.g., a gasket, an o-ring, silicone) can be disposed within the channel. The sealing member 689 can be used to help keep one or more elements (e.g., moisture, dirt) from outside the lens 670 from reaching the cavity 675 formed by the wall 673 of the lens 670. The bottom end of the lens 670 can abut against and couple (directly or indirectly) to the housing 685. In such a case, the sealing member 689 can help prevent ingress of various elements from outside the lens 670 to the cavity 675 at the junction where the lens 670 couples to the housing 685.

The lens 670 can have any of a number of shapes and/or sizes. The lens 670 can be made of any of a number of colors and have any of a range of opacities. The lens 670 can have any thickness that is uniform and/or varying along the wall 673. The lens 670 can be engineered to have any of a number of optical features integrated into the wall 673. The wall 673 can be made of any of a number of materials (e.g., glass, plastic). The inner surface 672 and/or the outer surface 671 can be coated with any of a number of materials. In any event, the lens 670 can be created to have an optional specific optical effect for light generated by the light assembly 310 while also offering protection (e.g., from wind, dirt, moisture, hail) to the obstruction light assembly 300 positioned within the cavity 675.

The housing 685 can be any type of enclosure atop of which can be disposed the obstruction light assembly 300. The housing 685 can be defined by an outer surface 681 and where the interior is solid or has one or more cavities. In some cases, one or more components (e.g., wiring, a power source 682) of the obstruction light 600 can be disposed within the housing 685. For example, as shown in FIG. 6, a power source 682 (e.g., a LED driver, a ballast, a battery) can be disposed within the housing 685.

In some cases, while not shown in FIG. 6, the top surface of the housing 685 can have a channel (similar to the optional channel 679 of the lens 670) disposed therein. In such a case, a sealing member (similar to the sealing member 689 described above) can be disposed in such channel. In certain example embodiments, one or more components (e.g., the sealing member 689, the lens 670) of the obstruction light 600 can help the obstruction light 600 meet one or more standards and/or regulations applicable to the environment in which the obstruction light 600 is placed. For example, the sealing member 689, the lens 670, and the housing 685 can prevent an incursion of water to the reflector and the light assembly when the housing and the lens is exposed to a water jet of 100 liters of water per minute under a pressure of 100 $kN/m^2$ at a distance of 3 meters for a duration of at least 3 minutes.

Example embodiments described herein allow an obstruction light to achieve high light intensity (e.g., a high lumen-to-candela conversion efficiency) while having a relatively low cost and compact design. Example embodiments can be used with any type of light source, such as undomed LEDs, to deliver high and efficient light intensity. These light sources can also be used to take advantage of favorable tolerancing due to a relatively small footprint of the obstruction light using example embodiments. Example embodiments can also be used in environments that require compliance with one or more standards and/or regulations.

Accordingly, many modifications and other embodiments set forth herein will come to mind to one skilled in the art to which example obstruction lights pertain having the benefit of the teachings presented in the foregoing descriptions and the associated drawings. Therefore, it is to be understood that example obstruction lights are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An obstruction light, comprising:

a reflector comprising a first parabolic portion and a second parabolic portion, wherein the first parabolic portion is inverted relative to the second parabolic portion so that a first parabolic portion curvature of the first parabolic portion is oriented as a substantial mirror image of a second parabolic portion curvature of the second parabolic portion; and a light assembly comprising at least one array of light sources coupled to the reflector and disposed between the first parabolic portion and the second parabolic portion, wherein the first parabolic portion and the second parabolic portion are coupled to the light assembly.

2. The obstruction light of claim 1, wherein the at least one array of light sources comprises a first plurality of light-emitting diodes (LEDs).

3. The obstruction light of claim 1, wherein the first curvature is substantially the same as the second curvature.

4. The obstruction light of claim 1, wherein the first parabolic portion has a first height, and wherein the second parabolic portion has a second height.

5. The obstruction light of claim 1, wherein the first parabolic portion has a first diameter, and wherein the second parabolic portion has a second diameter.

6. The obstruction light of claim 1, further comprising:

a plate disposed between the first parabolic portion and the second parabolic portion, wherein the light assembly is coupled to the plate.

7. The obstruction light of claim 6, wherein the plate has an aperture that traverses its center.

8. The obstruction light of claim 6, further comprising:

at least one clamp that mechanically couples the light assembly to the plate.

9. The obstruction light of claim 1, wherein the at least one array of light sources comprises a first array of light sources disposed on a first side of a light board of the light assembly and a second array of light sources disposed on a second side of the light board.

10. The obstruction light of claim 9, wherein the first array of light sources is directed toward the first parabolic portion, and wherein the second array of light sources is directed toward the second parabolic portion.

11. The obstruction light of claim 1, wherein the at least one array of light sources is disposed on a flexible light board of the light assembly.

12. The obstruction light of claim 11, wherein the at least one array of light sources is positioned between the flexible light board and the reflector.

13. The obstruction light of claim 11, wherein a portion of light emitted by the at least one array of light sources is directed toward the first parabolic portion, and wherein a remainder of the light emitted by the at least one array of light sources is directed toward the second parabolic portion.

14. The obstruction light of claim 1, further comprising:

a lens that encompasses the reflector and the light assembly.

15. The obstruction light of claim 14, further comprising:

a housing coupled to the lens, wherein the reflector and the light assembly are disposed atop the housing.

16. A reflector for an obstruction light, the reflector comprising:

a first parabolic portion having a first parabolic portion curvature; and a second parabolic portion having a second parabolic portion curvature, wherein the first parabolic portion and the second parabolic portion are each configured to be positioned adjacent to a light assembly comprising at least one array of light sources, wherein the first parabolic portion and the second parabolic portion are inverted relative to each other so that the first parabolic portion curvature of the first parabolic portion is oriented as a substantial mirror image of the second parabolic portion curvature of the second parabolic portion, and wherein the first parabolic portion and the second parabolic portion are coupled to the light assembly so that the light assembly is disposed between the first parabolic portion and the second parabolic portion.

17. The reflector of claim 16, wherein the first curvature and the second curvature reflect light emitted from the at least one array of light sources in a pattern that meets at least one standard for obstruction lights in warning of a hazard.

18. The reflector of claim 16, wherein the first parabolic portion has a first diameter and a first height, and wherein the second parabolic portion has a second diameter and a second height.

* * * * *